US008363070B2

(12) United States Patent
Yamamoto et al.

(10) Patent No.: US 8,363,070 B2
(45) Date of Patent: Jan. 29, 2013

(54) DRIVE CIRCUIT AND DISPLAY DEVICE

(75) Inventors: Keiichi Yamamoto, Tenri (JP); Asahi Yamato, Tokyo (JP); Kohji Saitoh, Tokorozawa (JP); Akizumi Fujioka, Tokyo (JP); Toshihiro Yanagi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1033 days.

(21) Appl. No.: 12/309,866

(22) PCT Filed: Jun. 14, 2007

(86) PCT No.: PCT/JP2007/061966

§ 371 (c)(1),
(2), (4) Date: Feb. 2, 2009

(87) PCT Pub. No.: WO2008/041394

PCT Pub. Date: Apr. 10, 2008

(65) Prior Publication Data

US 2009/0262124 A1 Oct. 22, 2009

(30) Foreign Application Priority Data

Oct. 2, 2006 (JP) ..... 2006-271197

(51) Int. Cl.
*G09G 5/10* (2006.01)

(52) U.S. Cl. ..... 345/690; 345/38; 345/48; 345/50; 345/211; 345/214; 345/549; 345/602

(58) Field of Classification Search ..... None
See application file for complete search history.

(56) References Cited

U.S. PATENT DOCUMENTS

| | | | | |
|---|---|---|---|---|
| 7,511,772 | B2 * | 3/2009 | Fujine et al. | 348/790 |
| 2003/0095090 | A1 | 5/2003 | Ham | |
| 2004/0201564 | A1 | 10/2004 | Sugino et al. | |
| 2004/0252111 | A1 | 12/2004 | Cheon et al. | |
| 2004/0263495 | A1 | 12/2004 | Sugino et al. | |
| 2006/0103682 | A1 | 5/2006 | Kunimori et al. | |
| 2008/0191995 | A1 | 8/2008 | Cheon et al. | |

FOREIGN PATENT DOCUMENTS

| | | |
|---|---|---|
| CN | 1407528 A | 4/2003 |
| CN | 1703650 A | 11/2005 |
| JP | 05-064110 | 3/1993 |
| JP | 2005-215333 | 8/2005 |

* cited by examiner

*Primary Examiner* — Antonio A Caschera
(74) *Attorney, Agent, or Firm* — Harness, Dickey & Pierce

(57) ABSTRACT

Correction data tables or look up tables (LUTs) are stored in a table memory. When an overshoot calculation section switches an active LUT, the overshoot calculation section obtains the new active LUT not out of an external memory but out of the table memory. A table managing section deletes, from the internal memory, LUTs to which the new active LUT does not switch over directly, for example non-adjacent LUTs, meanwhile the table managing section obtains a new adjacent LUT from the external memory so as to store the new adjacent LUT in the table memory. With the arrangement, it becomes possible for a drive circuit to (i) operate at the same processing speed as a drive circuit in which all tables are stored in the internal memory, and simultaneously, (ii) reduce the amount of memory.

9 Claims, 9 Drawing Sheets

DRIVE CIRCUIT AND DISPLAY DEVICE

TECHNICAL FIELD

The present invention relates to a drive circuit for driving a display device, and to a display device including the drive circuit.

BACKGROUND ART

An overshoot drive technique has been widely known as a technique for improving response speed in driving a display device. According to the technique, a correction data table (LUT) is prepared in advance. Image data of a current frame is compared with that of a previous frame (one frame before the current frame). Based on the result of the comparison, display drive data is produced with the use of values defined in the LUT.

The following description deals with a case where a liquid crystal display device adopts the overshoot drive technique. Liquid crystal usually has temperature dependence. That is, the liquid crystal has changes in its property depending on the temperature. The temperature of a display device varies widely. Especially, a liquid crystal display device applied to a mobile terminal device tends to have considerable changes in its temperature.

Therefore, it is necessary for a display device to keep display quality constant regardless of changes in its temperature. In order to attain the object, it has been attempted conventionally to (i) prepare LUTs for temperature ranges respectively in advance, and (ii) depending on a change in temperature, select and use one of the LUTs. Such a technique is disclosed in Patent Documents 1 and 2, for example.

Specifically, the technique of using the tables has been put into practice in the following two arrangements. (1) Tables are prepared for temperature ranges respectively, and all of the tables are stored inside a drive circuit in advance. If the temperature changes, a table corresponding to the changed temperature is obtained from an internal memory.

(2) Tables are prepared for temperature ranges respectively, and all of the tables are stored in an external memory of a drive circuit in advance. An internal memory stores only one table that is necessary at the time. If the temperature changes, the table of the internal memory is replaced with another table that is obtained from the external memory and corresponds to the changed temperature.

PATENT DOCUMENT 1

Japanese Unexamined Patent Publication No. 2005-004203 (Tokukai 2005-004203 (published on Jan. 6, 2005))

PATENT DOCUMENT 2

Japanese Unexamined Patent Publication No. 2003-207762 (Tokukai 2003-207762 (published on Jul. 25, 2003))

DISCLOSURE OF INVENTION

However, in the conventional arrangement (1), all the tables are stored in the internal memory of the drive circuit. Thereby, it is necessary to secure large memory capacity. Further, in the conventional arrangement (2), it is necessary for the internal memory to exchange data with the external memory every time a different table is needed. This slows down processing speed of the drive circuit.

A mobile terminal device will be one of main targets of a display device, in consideration of applicable fields of a display device in the future. A mobile terminal device has a limit in memory capacity. The internal memory of the drive circuit has a limit in memory capacity, as well. Therefore, it has been demanded to suppress the amount of memory, and simultaneously, to have an increase in processing speed of the drive circuit. With the two conventional arrangements, however, it is impossible to attain the object.

The present invention is made in view of the problem. An object of the present invention is to provide a drive circuit and a display device, each of which can (i) operate at the same processing speed as a drive circuit in which all tables are stored in an internal memory, and simultaneously, (ii) have a reduction in the amount of memory.

(Basic Arrangement of Drive Circuit)

In order to attain the object, a drive circuit of the present invention includes conversion section to convert input image data into output image data by using a table, corresponding to a current physical property, among tables which are prepared respectively for different predetermined physical properties of a display device, and each of which defines a relationship between input image data and output image data, said drive circuit, further including: an internal memory for storing at least three tables which respectively correspond to a plurality of the physical properties which are continuously switched over in the display device, the number of said at least three tables is less, by at least one, than the number of all of tables which are stored in an external memory and are provided for the different physical properties, respectively; and table managing section to (i) obtain a table located before a first end table from the external memory so as to store the table in the internal memory, and deleting a second end table from the internal memory, in a case where the conversion section newly uses the first end table, and (ii) obtaining a table located after the second end table from the external memory so as to store the table in the internal memory, and deleting the first end table from the internal memory, in a case where the conversion section newly uses the second end table, the first and second end tables being stored in the internal memory, a table located after the first end table being stored in the internal memory but a table located before the first end table not being stored in the internal memory, and a table located before the first end table being stored in the internal memory but a table located after the second end table not being stored in the internal memory, said conversion section to use a table that is stored in the internal memory and corresponds to the current physical property.

With the arrangement, the drive circuit converts the input image data into the output image data by using a table corresponding to a physical property (such as a temperature range, and an operating frequency). This conversion makes it possible to carry out the overshoot drive, for example.

The drive circuit switches over a table which is being used to another table, depending on a physical property of a display device. In other words, at least three tables are stored in the internal memory inside the drive circuit in advance, that is, a table corresponding to a current physical property of the display device, and two tables being located adjacent to the table. In a case where the physical property is a temperature range, at least three tables are stored in the internal memory inside the drive circuit in advance, that is, a table corresponding to a current temperature range of the display device, and two tables located adjacent to the table, for example. This allows the drive circuit to select and use the table corresponding to the current temperature range, among these (three or more) tables.

Further, the number of the tables stored in the drive circuit in advance is less, by at least one, than the number of all of the tables that are stored in the external memory and correspond to physical properties (temperature ranges) respectively. For example, seven tables are stored in the external memory, meanwhile three of the seven tables are stored in the internal memory (internal memory) of the drive circuit.

In the drive circuit, the table managing section manages the tables stored in the internal memory, when the conversion section switches over the internal memory. Specifically, the table managing section manages the tables so that the tables being located adjacent to the table that is being used by the conversion section are stored in the internal memory all the time. For example, tables B, C, and D, which respectively correspond to three continuous temperature ranges, are stored in the internal memory in advance.

The table C located after the table B is stored in the internal memory, but the table A located before the table B is not stored in the internal memory. That is, the table B corresponds to the first end table.

The table B is located before the table C, and the table D is located after the table C. Both of the tables B and D are stored in the internal memory. That is, the table C corresponds to neither the first nor second end table.

The table E located after the table D is stored in the internal memory, but the table C located before the table D is not stored in the internal memory. That is, the table D corresponds to the second end table.

The following explains a case where the physical properties are temperature ranges. In a case where the temperature of the display device belongs to the temperature range corresponding to the table C, the conversion section uses the table C. Here, the temperature of the display device changes so as to belong to the temperature range corresponding to the table D, for example. At this time, the conversion section switches over from the table C, which is being used, to the table D. Since the table D has been already stored in the internal memory, it is possible for the conversion section to switch over from the table that is being used to the table D in a short time.

The table D (the second end table) is located adjacent to the tables C and E. Here, the table E, which is located after the table D, is not stored in the internal memory. Therefore, the table managing section obtains the table E from the external memory so as to store the table E in the internal memory. Meanwhile, the table managing section deletes the table B (the first end table) from the internal memory. This is because the table A, which is located before the table B, is not stored in the internal memory. With such processing, the tables C through E are stored in the internal memory. At this time, the table C newly corresponds to the first end table, and the table E newly corresponds to the second end table.

Accordingly, the conversion section, which is using the table D this time, can select the table C or E stored in the internal memory, when the conversion section switches over from the table D, which is being used, to the table C or E next.

As described above, the table managing section manages the tables so that the conversion section can select a table from the tables stored in the internal memory every time the conversion section switches over from the table that is being used to another table. Therefore, it becomes possible to complete the switching processing in a shorter time, as compared with a case where the table is obtained from the external memory.

Further, the number of the tables stored in the internal memory is always set to be less, by at least one, than the number of all of the tables stored in the external memory. Therefore, it becomes possible to reduce the amount of memory of the internal memory, as compared with a case where all the tables are stored in the internal memory. As a result, it becomes possible to further reduce the amount of memory of a whole display device.

As described above, the drive circuit of the present invention can (i) operate at the same processing speed as a drive circuit in which all of the tables are stored in the internal memory, and simultaneously, (ii) further reduce the amount of memory of the internal memory.

(Physical Property: Temperature Range)

Further, in the drive circuit of the present invention, each of the predetermined physical properties is preferably a temperature range to which a temperature of the display device belongs.

With the arrangement, it becomes possible to provide a drive circuit which can drive the display device optimally in accordance with the current temperature of the display device.

(Storing Three Tables)

Furthermore, in the drive circuit of the present invention, among all of the tables stored in the external memory, three tables, which respectively correspond to three of the physical properties which are continuously switched over in the display device, are preferably stored in the internal memory.

With the arrangement, it is possible for the drive circuit to (i) operate at the same processing speed as a drive circuit in which all of the tables are stored, and simultaneously, to (ii) suppress the amount of memory as small as possible.

(Storing Four Tables)

Moreover, in the drive circuit of the present invention, among all of the tables stored in the external memory, four tables, which respectively correspond to four of the physical properties which are continuously switched over in the display device, are preferably stored in the internal memory.

With the arrangement, tables which respectively correspond to four physical properties (four continuous temperature ranges, for example) which are switched over continuously in the display device, are stored in the internal memory in advance. For example, tables B, C, D, and E are stored in the internal memory in advance.

The table C located after the table B is stored in the internal memory, but the table A located before the table B is not stored in the internal memory. That is, the table B corresponds to the first end table.

The table B is located before the table C, and the table D is located after the table C. Both of the tables B and D are stored in the internal memory. That is, the table C corresponds to neither the first nor second end table.

The table C is located before the table D, and the table E is located after the table D. Both of the tables C and E are stored in the internal memory. That is, the table D corresponds to neither the first nor second end table.

The table D located before the table E is stored in the internal memory, but the table F located after the table E is not stored in the internal memory. That is, the table E corresponds to the second end table.

Here, the conversion section is to use the table C, for example. If the temperature of the display device changes so as to belong to the temperature range corresponding to the table D, the conversion section will use the table D next. At this time, the tables C and E, which are located adjacent to the table D, have been already stored in the internal memory. Therefore, the table managing section leave the combination of the tables stored in the internal memory as it is. That is, the table managing section does not newly obtain a table from the external memory.

Further, for example, the temperature of the display device changes so as to belong to the temperature range corresponding to the table C again, while the conversion section is to use the table D. In this case, the conversion section will use the table C next. At this time, the tables B and D, which are located adjacent to the table C, have been already stored in the internal memory. Therefore, the table managing section leave the combination of the tables stored in the internal memory, as it is. That is, the table managing section does not newly obtain a table from the external memory.

As described above, four tables are stored in the internal memory, so that it becomes possible to reduce the number of times that processing of obtaining a table from the external memory is carried out.

(Drive Circuit Employing Difference Table)

In order to attain the object, a drive circuit of the present invention includes: conversion section to convert input image data into output image data by using tables, which respectively correspond to different predetermined physical properties of a display device, and each of which defines a relationship between input data and output data; table creating section, in a case where a current physical property of the display device is changed into another physical property to which the current physical property is switched over, for creating a table that the conversion section uses after the physical property is changed, the table creating section to create the table by applying a difference table to a table corresponding to the current physical property, the difference table being based on a difference between the table corresponding to the current physical property and a table corresponding to said another physical property; said drive circuit further comprising: an internal memory for storing at least three difference tables which respectively correspond to a plurality of the physical properties which are continuously switched over in the display device, the number of said at least three difference tables is less, by at least one, than the number of all of difference tables which are stored in an external memory and are provided for the different physical properties, respectively, the difference table being based on a difference between a table corresponding to a certain physical property and another table corresponding to another physical property to which the certain physical property is switched over; difference table managing section to (i) obtain a difference table located before a first end difference table from the external memory so as to store the difference table in the internal memory, and deleting a second end difference table from the internal memory, in a case where the table creating section newly uses the first end difference table, and (ii) obtaining a difference table located after the second end difference table from the external memory so as to store the difference table in the internal memory, and deleting the first end difference table from the internal memory, in a case where the table creating section newly uses the second end difference table, the first and second end difference tables being stored in the internal memory, a difference table located after the first end difference table being stored in the internal memory but a difference table located before the first end difference table not being stored in the internal memory, and a difference table located before the first end difference table being stored in the internal memory but a difference table located after the second end difference table not being stored in the internal memory.

With the arrangement, the drive circuit converts the input image data into the output image data by using a table corresponding to a predetermined physical property (such as a temperature range, and an operating frequency) of the display device. This conversion makes it possible to carry out the overshoot drive, for example.

The drive circuit switches over from the table that is being used to another table, depending on a physical property of the display device. Specifically, the drive circuit uses a table created by the table creating section. In a case where the current physical property of the display device is continuously changed into another physical property, the table creating section applies a difference table to the table corresponding to the current physical property. The difference table is based on a difference between the table corresponding to the current physical property and another table corresponding to the another physical property. Thereby, the table creating section creates the table that will be used by the conversion section after the physical property is changed.

At least three difference tables, which correspond to a plurality of physical properties that are switched over continuously in the display device, are stored in the internal memory of the drive circuit. The difference table is based on a difference between a table corresponding to a certain physical property and another table corresponding to another physical property to which the certain physical property is switched over continuously. For example, in a case where the physical properties are the temperature ranges, at least three difference tables, which (i) correspond to a plurality of continuous temperature ranges respectively, and (ii) are differences between a table corresponding to a certain temperature range, and tables corresponding to temperature ranges being located adjacent to the certain temperature range, are stored in the internal memory of the drive circuit. The table creating section uses the difference tables stored in the internal memory so as to create the table that the drive circuit uses.

Further, the number of the difference tables stored in the drive circuit is less, by at least one, than the number of the difference tables that are stored in the external memory and provided for the physical properties respectively. In the case where the physical properties are the temperature ranges, the number of the difference tables stored in the drive circuit is less, by at least one, than the number of the difference tables that are stored in the external memory and provided for the temperature ranges respectively. For example, seven difference tables are stored in the external memory, meanwhile three of the seven difference tables are stored in the internal memory of the drive circuit.

When the table creating section uses a new difference table, the difference table managing section manages the difference tables stored in the internal memory. Specifically, the difference table managing section manages the tables so that two difference tables located adjacent to the difference table that is being used by the table creating section are stored in the internal memory all the time. For example, difference tables B, C, and D, which correspond to three continuous temperature ranges respectively, are stored in the internal memory in advance.

The difference table C located after the difference table B is stored in the internal memory, but the difference table A located before the difference table B is not stored in the internal memory. That is, the difference table B corresponds to the first end difference table.

The difference table B is located before the difference table C, and the difference table D is located after the difference table C. Both of the difference tables B and D are stored in the internal memory. That is, the difference table C corresponds to neither the first nor second end difference table.

The difference table C located before the difference table D is stored in the internal memory, but the difference table E located after the difference table D is not stored in the internal memory. That is, the difference table D corresponds to the second end difference table.

The following explains a case where the physical properties are temperature ranges. When the temperature of the display device belongs to the temperature range corresponding to the difference table C, the table creating section uses the difference table C. Here, the temperature of the display device changes so as to belong to the temperature range corresponding to the difference table D, for example. At this time, the conversion section switches over from the difference table C, which is being used, to the difference table D. The difference table D has been already stored in the internal memory, so that it is possible for the table creating section to switch over from the difference table that is being used to the difference table D in a short time.

The difference table D (the second end difference table) is located adjacent to the difference tables C and E. Here, the difference table E, which is located after the difference table D, is not stored in the internal memory. Therefore, the difference table managing section obtains the difference table E from the external memory so as to store the difference table E in the internal memory. Meanwhile, the difference table managing section deletes the difference table B (the first end difference table) from the internal memory. This is because the difference table A, which is located before the difference table B, is not stored in the internal memory. With such processing, the difference tables C through E are stored in the internal memory. Accordingly, the difference table C newly corresponds to the first end table, and the difference table E newly corresponds to the second end table.

At this time, the conversion section uses the table D created by the table creating section. Further, in a case where the conversion section switches over from the table D, which is being used, to the table C or the difference table E, the table creating section can use the difference table C or E stored in the internal memory in advance.

As described above, the difference table managing section manages the difference tables, so that it is possible for the table creating section to obtain, from the internal memory at any time, the difference table that will be used next. Accordingly, it becomes possible to complete the switching processing in a shorter time, as compared with a case where a difference table is obtained from the external memory.

Further, the number of the difference tables stored in the internal memory is always less, by at least one, than the number of all of the difference tables stored in the external memory. Accordingly, it is possible to further reduce the amount of memory of the internal memory, as compared with a case where all of the difference tables are stored in the internal memory. As a result, it becomes possible to further reduce the amount of memory of a whole display device.

As described above, the drive circuit of the present invention can (i) operate at the same processing speed as a drive circuit in which all difference tables are stored in the internal memory, and simultaneously, (ii) reduce the amount of memory of the internal memory.

(Physical Properties: Temperature Ranges)

Further, in the drive circuit of the present invention, each of the predetermined physical properties is preferably a temperature range to which a temperature of the display device belongs.

With the arrangement, it is possible to provide a drive circuit which can drive a display device optimally in accordance with a current temperature of the display device.

(Storing Three Difference Tables)

Furthermore, in the drive circuit of the present invention, among all of the difference tables stored in the external memory, three difference tables, which respectively correspond to three of the physical properties which are continuously switched over in the display device, are preferably stored in the internal memory.

With the arrangement, it is possible for the drive circuit to (i) operate at the same processing speed as a drive circuit in which all of the difference tables are stored, and simultaneously, (ii) suppress the amount of memory as small as possible.

(Storing Four Difference Tables)

Moreover, in the drive circuit of the present invention, among all of the difference tables stored in the external memory, four difference tables, which respectively correspond to four of the physical properties which are switched over in the display device, are preferably stored in the internal memory.

With the arrangement, tables which respectively correspond to four physical properties (four continuous temperature ranges, for example) which are switched over continuously in the display device, are stored in the internal memory in advance. For example, difference tables B, C, D, and E are stored in the internal memory in advance.

The difference table C located after the difference table B is stored in the internal memory, but the difference table A located before the difference table B is not stored in the internal memory. That is, the difference table B corresponds to the first end difference table.

The difference table B is located before the difference table C, and the difference table D is located after the difference table C. Both of the difference tables B and D are stored in the internal memory. That is, the difference table C corresponds to neither the first nor second end difference table.

The difference table C is located before the difference table D, and the difference table E is located after the difference table D. Both of the difference tables C and E are stored in the internal memory. That is, the difference table D corresponds to neither the first end difference table nor the second end difference table.

The difference table D located before the difference table E is stored in the internal memory, but the difference table F located after the difference table E is not stored in the internal memory. That is, the difference table E corresponds to the second end difference table.

Here, the conversion section is to use the table C which is created based on the difference table C, for example. If the temperature of the display device changes so as to belong to the temperature range corresponding to the table D, the table creating section creates the table D by using the difference table D. At this time, the conversion section will use the table D created by the table creating section next.

Here, the difference tables C and E, which are located adjacent to the difference table D, have been already stored in the internal memory. Therefore, the difference table managing section leave the combination of the difference tables stored in the internal memory as it is. In other words, the difference table managing section does not newly obtain a difference table from the external memory.

Further, if the conversion section is using the table D, and the temperature of the display device changes so as to belong to the temperature range corresponding to the table C again, the table creating section creates the table C by using the difference table C. At this time, the conversion section will use the table C created by the table creating section next.

Here, the difference tables B and D, which are located adjacent to the difference table C, have been already stored in the internal memory. Therefore, the difference table managing section leaves the combination of the difference tables stored in the internal memory as it is. In other words, the difference table managing section does not newly obtain a difference table from the external memory.

As described above, four difference tables are stored in the internal memory, so that it is possible to further reduce the number of times that the processing of obtaining a difference table from the external memory is carried out.

(Display Device)

In order to attain the object, a display device of the present invention includes any one of the drive circuits described above.

With the arrangement, it is possible to provide a display device which can (i) operate at the same processing speed as a display device in which all of the tables are stored in the internal memory, and simultaneously (ii) reduce the amount of memory of a whole display device.

Additional objects, features, and strengths of the present invention will be made clear by the description below. Further, the advantages of the present invention will be evident from the following explanation in reference to the drawings.

EXPLANATION OF LETTERS AND NUMERALS

1. LIQUID CRYSTAL DRIVE CIRCUIT (DRIVE CIRCUIT)
2. LIQUID CRYSTAL CONTROLLER
3. LIQUID CRYSTAL PANEL
4. TEMPERATURE SENSOR
6. EXTERNAL MEMORY
10. OVERSHOOT CALCULATION SECTION (CONVERSION SECTION, TABLE MANAGING SECTION)
11. FRAME MEMORY
12. TABLE MANAGING SECTION
13. TABLE MEMORY (INTERNAL MEMORY)
14. REGISTER REGION
50. LIQUID CRYSTAL DISPLAY DEVICE (DISPLAY DEVICE)

BEST MODE FOR CARRYING OUT THE INVENTION

One embodiment of the present invention is described below with reference to FIGS. 1 through 9. In the present embodiment, a liquid crystal drive circuit 1 provided in a liquid crystal display device 50 is explained in detail as a concrete example of a drive circuit of the present invention.

(Arrangement of Liquid Crystal Drive Circuit 1)

Figure 1:
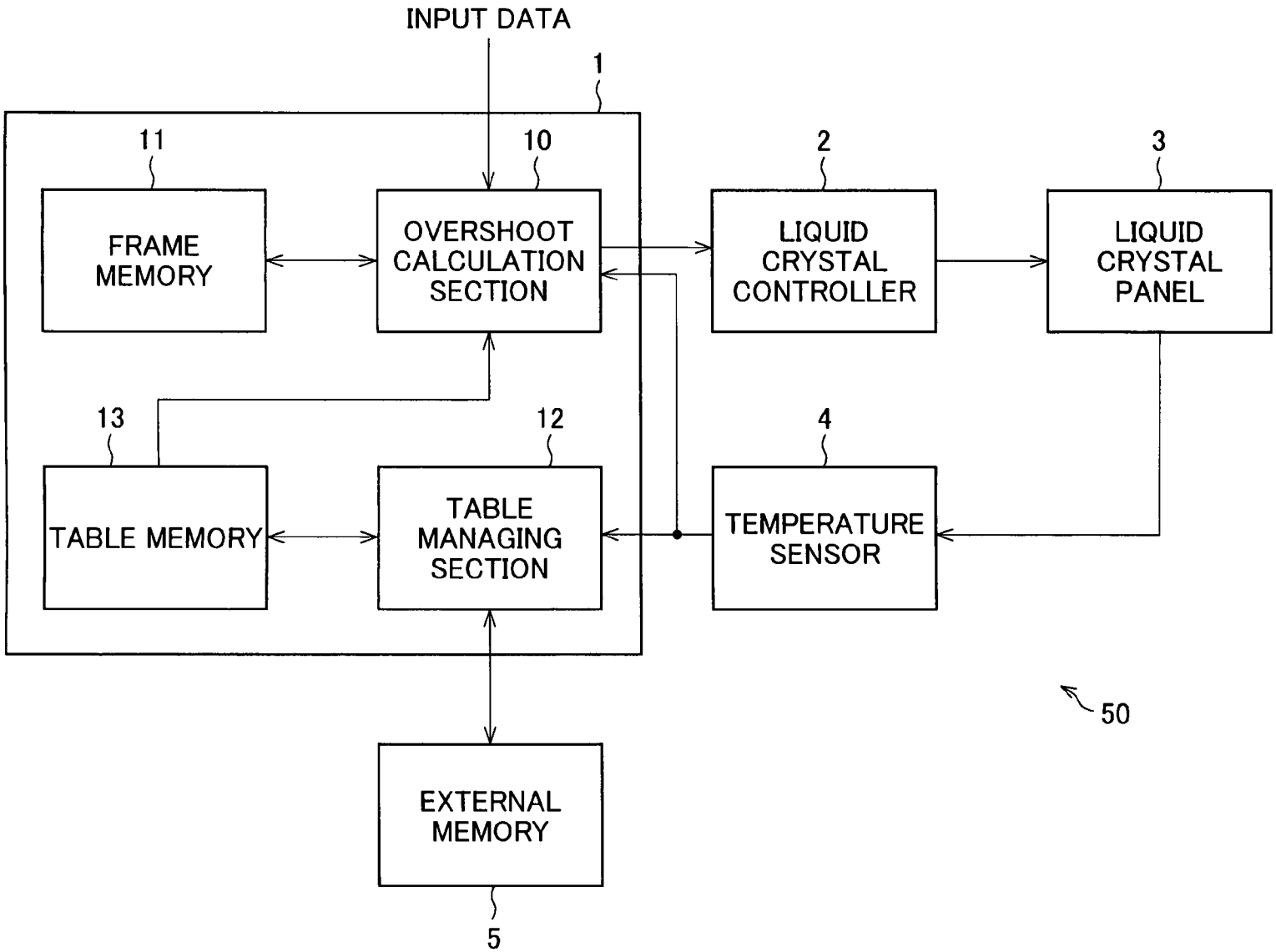
FIG. 1 is a block diagram illustrating a main part of a liquid crystal display device including a liquid crystal drive circuit in accordance with an embodiment of the present invention.

The following description deals with the liquid crystal drive circuit 1 of the present embodiment with reference to FIG. 1.

FIG. 1 is a block diagram illustrating a main part of the liquid crystal display device 50 including the liquid crystal drive circuit 1 in accordance with the present embodiment of the present invention. As illustrated in FIG. 1, the liquid crystal display device 50 (display device) includes a liquid crystal drive circuit 1 (drive circuit), a liquid crystal controller 2, a liquid crystal panel 3, a temperature sensor 4, and an external memory 5.

The liquid crystal display device 50 also includes other various components so as to function as a liquid crystal display device. However, such components are not related to the explanation of the liquid crystal drive circuit 1 of the present invention, and therefore are omitted in FIG. 1.

As illustrated in FIG. 1, the liquid crystal drive circuit 1 includes an overshoot calculation section 10 (conversion section, table creating section), a frame memory 11, a table managing section 12 (table managing section, difference table managing section), and a table memory 13.

(Overshoot Drive)

The liquid crystal display device 50 is driven by the overshoot drive method in order to improve response speed of liquid crystal display. Specifically, in the liquid crystal display device 50, the liquid crystal drive circuit 1 stores data (input image data) in the frame memory 11. Then, the liquid crystal drive circuit 1 compares the input data (last input data) stored in the frame memory 11 with the next input image data. Depending on a result of the comparison, the liquid crystal drive circuit 1 converts the input image data into output image data with the use of a predetermined table (lookup table, LUT) prepared in advance (if necessary), and outputs the output image data. That is, the LUT is table data which defines a relationship between the input image data and the output image data. The data thus outputted is inputted into the liquid crystal controller 2. Finally, the liquid crystal panel 3 is driven.

Further, liquid crystal of the liquid crystal display device 50 has a temperature property. In other words, the liquid crystal has a change in its property depending on the temperature. Therefore, the liquid crystal display device 50 includes LUTs which are set so as to correspond to temperature ranges optimally and respectively. With the arrangement, the liquid crystal drive circuit 1 selects and uses an LUT that corresponds to a current temperature range. Thereby, it is possible for the liquid crystal drive circuit 1 to drive the liquid crystal to display images optimally in any of the temperature ranges.

(Storing LUTs)

Figure 2:
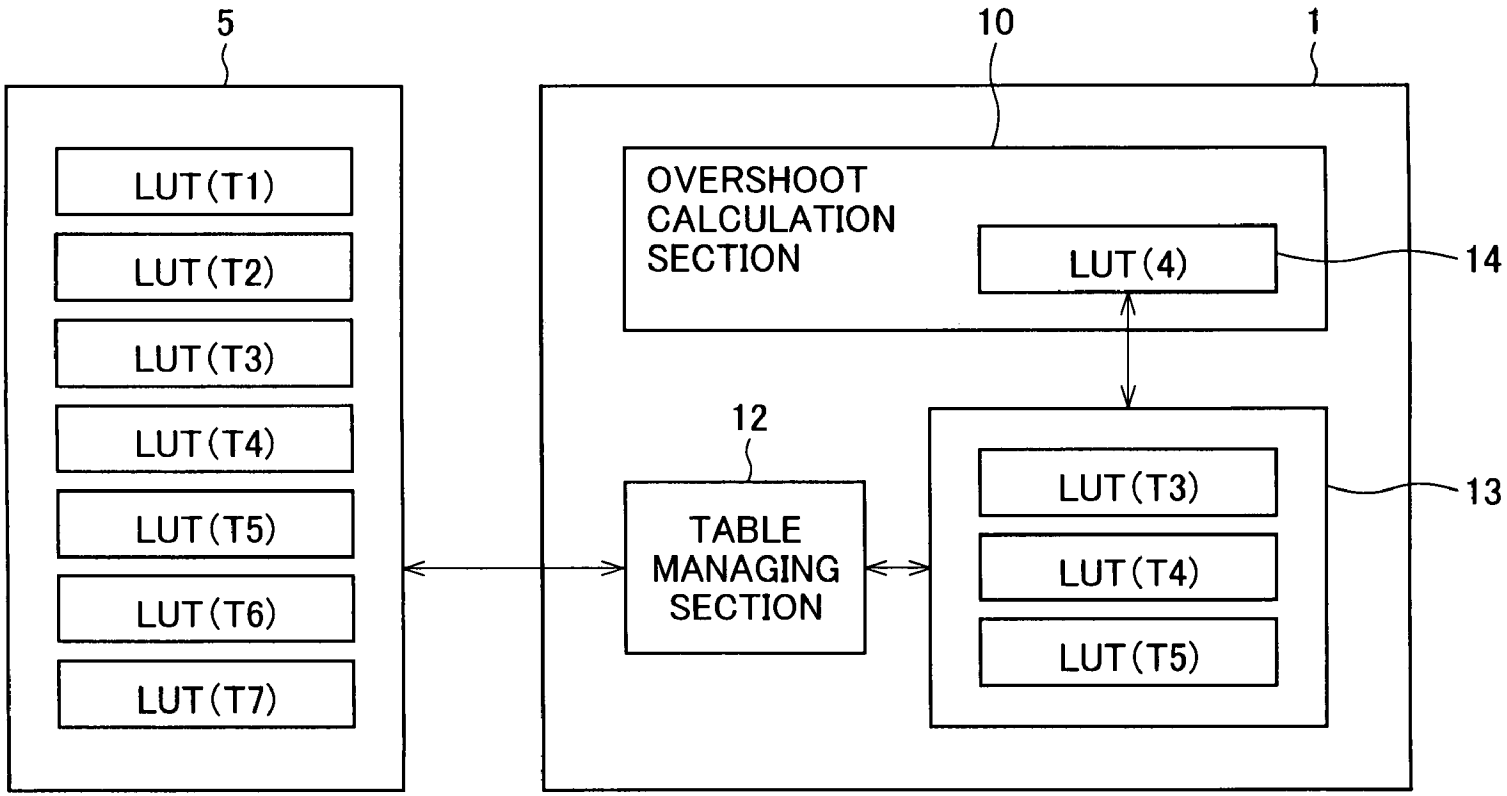
FIG. 2 illustrates positions to which LUTs are stored respectively in the liquid crystal display device.

As compared with the conventional techniques, the liquid crystal display device 50 has unprecedented features in (i) which member (memory) stores the LUT for each temperature range, and (ii) how the LUTs are switched over to each other. First, the following explains, in the liquid crystal display device 50, (i) which member stores LUTs that correspond to temperature ranges respectively, and (ii) how many LUTs are stored in the member, with reference to FIG. 2. FIG. 2 illustrates positions to which the LUTs are stored respectively in the liquid crystal display device 50.

A total of seven LUTs are prepared for temperature ranges respectively in the liquid crystal display device in advance. That is, the temperature range is divided into continuous seven ranges, namely temperature ranges T1 through T7. T1 covers a range from 50° C. to 60° C., T2 covers a range from 40° C. to 50° C., T3 covers a range from 30° C. to 40° C., T4 covers a range from 20° C. to 30° C., T5 covers a range from 10° C. to 20° C., T6 covers a range from 0° C. to 10° C., and T7 covers temperatures below 0° C. As such, each temperature range is arranged to be adjacent to another temperature range.

The liquid crystal display device 50 is provided with the LUTs (T1) through (T7) that correspond to the temperature ranges T1 through T7 respectively, in advance. Specifically, all of the seven LUTs are stored in the external memory 5 outside the liquid crystal drive circuit 1. The external memory 5 is a nonvolatile memory, such as an EEPROM.

The table memory 13 (internal memory) is provided inside the liquid crystal drive circuit 1. Here, the current temperature of the liquid crystal display device 50 is within the temperature range T4, for example. In this case, first of all, among the LUTs (T1) through (T7) stored in the external memory 5, the LUT (T4) is stored in the table memory 13. The LUT (T4) corresponds to the temperature range to which the current temperature of the liquid crystal display device 50 belongs. Further, the LUT (T3), which corresponds to the temperature range T3 being adjacent to and lower than the temperature range T4, is also stored in the table memory 13. Furthermore, the LUT (T5), which corresponds to the temperature range T5 being adjacent to and higher than the temperature range T4, is stored in the table memory 13, as well.

In other words, a total of three LUTs are stored in the table memory 13, that is, the LUT corresponding to the current temperature range T4, and the LUTs corresponding to the temperature ranges being adjacent to T4.

When performing correction calculation processing with respect to the input image data, the overshoot calculation section 10 uses the LUT that, stored in the table memory 13, corresponds to the temperature range to which the current temperature of the liquid crystal display device 50 belongs. At this time, the LUT obtained from the table memory 13 is stored in a register region 14 inside the overshoot calculation section 10. This prevents the overshoot calculation section 10 from repeatedly accessing the table memory to obtain the LUT. Thereby, it becomes possible to further improve the processing speed.

(Switch-Over of LUT that is Being Used)

In the liquid crystal display device 50, the temperature sensor 4 measures the temperature of the liquid crystal display device 50, and sends the measured results to the overshoot calculation section 10 and the table managing section 12, at predetermined intervals. It is preferable to measure the temperature at, particularly, the liquid crystal panel 3 in the liquid crystal display device 50. The table managing section 12 selects the LUT that corresponds to the temperature range to which the current temperature of the liquid crystal display device 50 belongs, and uses the LUT in the overshoot calculation. Meanwhile, the table managing section 12 manages the LUTs which are stored in the table memory 13. Specifically, in a case where the temperature of the liquid crystal display device 50 changes so as to belong to another temperature range, the table managing section 12 accesses the external memory 5 to obtain another LUT which should be newly stored in the table memory 13.

Figure 3:
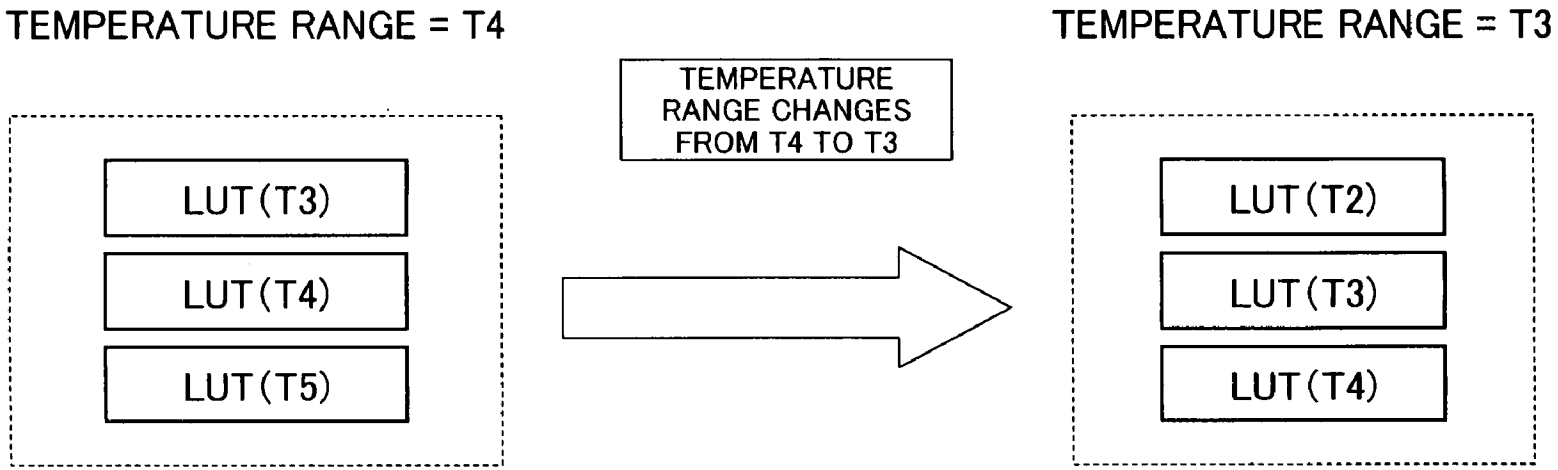
FIG. 3 illustrates how a combination of LUTs stored in a table memory is changed.

The processing described above is explained below with reference to FIG. 3. FIG. 3 illustrates how a combination of the LUTs stored in the table memory 13 is changed.

When the current temperature of the liquid crystal display device 50 changes, and therefore belongs not to the current temperature range but to another temperature range being adjacent to the current temperature range, the overshoot calculation section 10 sets another LUT corresponding to the another temperature range, as a new current LUT. Here, the temperature range to which the current temperature belongs is T4, for example. At this time, as described above, the LUT (T4) corresponding to T4, and the LUTs (T5) and (T6) located adjacent to the LUT (T4), are stored in the table memory 13 in advance.

Here, the temperature range to which the current temperature of the liquid crystal display device 50 belongs changes from T4 to T3. At this time, the overshoot calculation section 10 switches over from the LUT (T4), which is being used, to the LUT (T3). In the liquid crystal drive circuit 1, the LUT (T3) has been already stored in the table memory 13. Therefore, the overshoot calculation section 10 reads the LUT (T3) not out of the external memory 5 but out of the table memory 13. The overshoot calculation section 10 stores the LUT (T3) in the register region 14, and uses the LUT (T3).

Usually, the table memory 13 is transferred from the external memory 5 to the liquid crystal drive circuit 1 at a speed considerably slower than a speed at which the LUT is read out of the table memory 13. Accordingly, by reading out the LUT which is already provided in the table memory 13, the overshoot calculation section 10 can reduce a period for switching over between LUTs. This can speed up the overshoot calculation processing.

At this point, the LUT that is being used by the overshoot calculation section 10 has been switched over from the LUT (T4) to the LUT (T3). Therefore, it is necessary for the table memory 13 to store the LUT (T3) corresponding to the temperature range T3 of the liquid crystal display device 50, and the LUTs (T4) and (T5) located adjacent to the LUT (T3).

The temperature sensor 4 has given the table managing section 12 a notice that the temperature range to which the temperature of the liquid crystal display device 50 belongs changed from T4 into T3. Therefore, the table managing section 12 obtains, from the external memory 5, the LUT (T2) corresponding to the temperature range T2 that is adjacent to, and lower than the current temperature range T3. The table managing section 12 stores the LUT (T2) in the table memory 13. Meanwhile, the table managing section 12 deletes the LUT (T5) from the table memory 13.

With such processing, a total of four tables are stored in the table memory 13, that is, the LUTs (T2) through (T4), in a case where the temperature of the liquid crystal display device 50 belongs to the temperature range T3. In other words, depending on a change in temperature range, the following three tables are stored in the table memory 13.

A table corresponding to the current temperature range of the liquid crystal display device 50.

A table corresponding to a low temperature range that is adjacent to, and lower than the current temperature range of the liquid crystal display device 50.

A table corresponding to a high temperature range that is adjacent to, and higher than the current temperature range of the liquid crystal display device 50.

The number of the LUTs stored in the table memory 13 is not limited to three. That is, the table memory 13 may store any number of LUTs as long as (i) the LUTs are at least three LUTs which correspond to a plurality of continuous temperature ranges T1 through T7 respectively; and (ii) the number of the LUTs stored in the table memory is less, by at least one, than the number of all of the tables (LUTs (T1) through (17)) that are stored in the external memory 5, and correspond to the temperature ranges respectively.

Therefore, the overshoot calculation section 10 only has to be one which converts the input image data into the output image data by using, among the LUTs (T1) through (T7), the LUT corresponding to the current temperature range to which the current temperature of the liquid crystal display device 50 belongs.

Further, the table managing section 10 only has to be one which (i) obtains the LUT (T1) located before the LUT (T2) from the external memory 5 so as to store the LUT (T1) in the table memory 13, and simultaneously deletes the LUT (T4) from the table memory 13, in a case where the overshoot calculation section 10 newly uses the LUT (T2), and (ii) obtains the LUT (T5) located after the LUT (T4) from the external memory 5 so as to store the LUT (T5) in the table memory 13, and simultaneously deletes the LUT (T2) from the table memory 13, in a case where the overshoot calculation section 10 newly uses the LUT (T4), the LUTs (T2) and (T4) being stored in the table memory 13, the LUT (T2) being a first end table which is located before the LUT (T3) that is stored in the table memory 13, but located after the LUT (T1) that is not stored in the table memory 13, the LUT (T4) being a second end table which is located after the LUT (T3) that is stored in the table memory 13, but located before the LUT (T5) that is not stored in the table memory 13.

With the arrangement, the overshoot calculation section 10 uses the LUT that is stored in the overshoot calculation section 10 and the table memory 13 and corresponds to the current temperature range of the liquid crystal display device 50.

(Example of Storing Four LUTs)

Thus, the number of the LUTs stored in the table memory 13 is not limited to three, and may be any number, as long as the number is at least four, and less, by at least one, than the number of all of the LUTs stored in the external memory 5. The following description explains an example of a case where a total of four LUTs, including the LUT corresponding to the temperature range to which the current temperature of the liquid crystal display device 50 belongs, are stored in the table memory 13 in advance.

Figure 4:
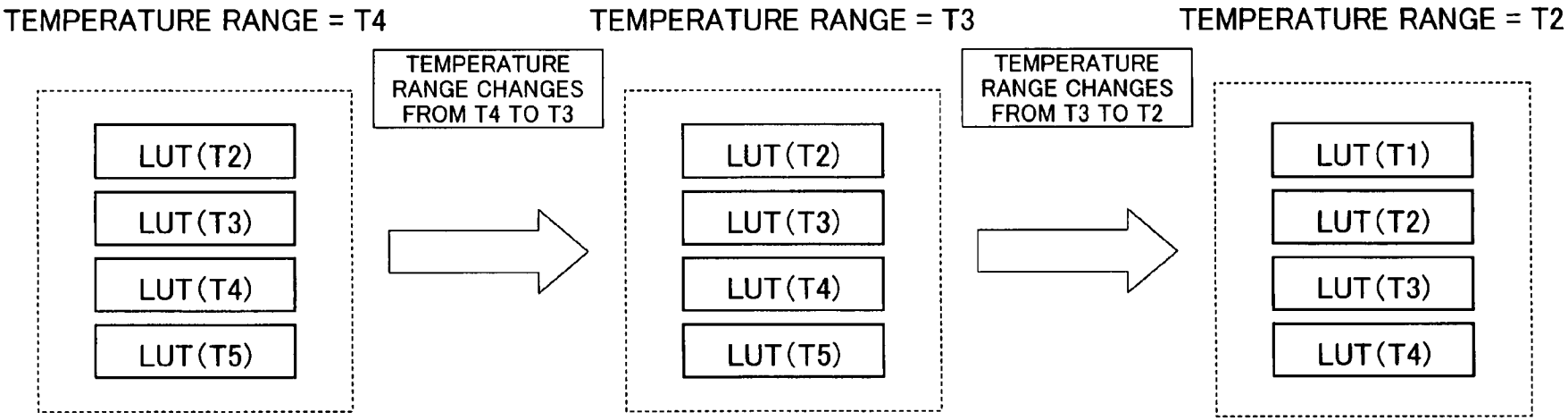
FIG. 4 illustrates how a combination of LUTs stored in the table memory is changed along with changes in temperature range to which a current temperature of the liquid crystal display device belongs.

FIG. 4 illustrates how a combination of four LUTs stored in the table memory 13 is changed along with changes in current temperature range to which the temperature of the liquid crystal display device 50 belongs.

Here, the current temperature of the liquid crystal display device 50 belongs to the temperature range T4, for example. At this point, the LUT (T4) corresponding to T4, the LUTs (T3) and (T5) located adjacent to the LUT (T4), and the LUT (T2) corresponding to the temperature range T2 which is lower than the temperature range T3 are stored in the table memory 13 in advance. That is, a total of four tables, namely the LUTs (T2) through (T4), which correspond to a plurality of the continuous temperature ranges T2 through T4 respectively, are stored in the table memory 13.

Here, the temperature range to which the current temperature of the liquid crystal display device 50 belongs changes from T4 to T3, for example. At this time, the overshoot calculation section 10 switches over from the LUT (T4), which is being used, to the LUT (T3). The LUT (T3) has been already stored in the table memory 13 in the liquid crystal drive circuit 1. Therefore, the overshoot calculation section 10 reads the LUT (T3) not out of the external memory 5 but out of the table memory 13. The overshoot calculation section 10 stores the LUT (T3) in the register region 14, and uses the LUT (T3).

Two tables located adjacent to the LUT (T3), that is, the LUTs (T2) and (T4) have been already stored in the table memory 13. Accordingly, the table managing section 12 does not change the combination of the LUTs stored in the table memory 13.

Here, the temperature range to which the current temperature of the liquid crystal display device 50 belongs further changes from T3 to T2, for example. At this time, the overshoot calculation section 10 switches over from the LUT (T3), which is being used, to the LUT (T2). The LUT (T2) has been already stored in the table memory 13 in the liquid crystal drive circuit 1. Accordingly, the overshoot calculation section 10 reads the LUT (T2) not out of the external memory 5 but out of the table memory 13. The overshoot calculation section 10 stores the LUT (T2) in the register region 14, and uses the LUT (T2).

At this point, the LUT that is being used by the overshoot calculation section 10 has been switched over from the LUT (T3) to the LUT (T2). Therefore, it is necessary for the table memory 13 to store the LUT (T2) corresponding to the current temperature range T2, and the LUTs (T1) and (T3) located adjacent to the LUT (T2).

The LUT (T3) has been already stored in the table memory 13, but the LUT (T1) is not stored in the table memory 13. The temperature sensor 4 has given the table managing section 12 a notice that the temperature range to which the current temperature of the liquid crystal display device 50 belongs changed from T3 to T2. Therefore, the table managing section 12 obtains, from the external memory 5, the LUT (T1) corresponding to the temperature range T1, which is adjacent to, and lower than T2. The table managing section 12 stores the LUT (T1) in the table memory 13. Meanwhile, the table managing section 12 deletes the LUT (T6) from the table memory 13.

With such processing, a total of four tables, namely the LUTs (T1) through (T4), are stored in the table memory 13, in a case where the current temperature of the liquid crystal display device 50 belongs to the temperature range T2. That is, depending on a change in temperature range, the following four tables are stored in the table memory 13.

A table corresponding to the current temperature range of the liquid crystal display device 50.

A table corresponding to a low temperature range which is adjacent to, and lower than the current temperature range of the liquid crystal display device 50.

A table corresponding to a high temperature range which is adjacent to, and higher than the current temperature range of the liquid crystal display device 50.

A table corresponding to a temperature range which is adjacent to, and lower than the low temperature range.

Alternatively, the following four tables are stored in the table memory 13.

A table corresponding to the current temperature range of the liquid crystal display device 50.

A table corresponding to a low temperature range which is adjacent to, and lower than the current temperature range of the liquid crystal display device 50.

A table corresponding to a high temperature range which is adjacent to, and higher than the current temperature range of the liquid crystal display device 50.

A table corresponding to a temperature range which is adjacent to, and higher than the high temperature range.

Thus, as compared with the arrangement in which three LUTs are stored in the table memory 13, the arrangement in which four LUTs are stored in the table memory 13 in advance allows the table managing section 12 to have a reduction in the number of times that the table managing section 12 accesses the external memory 5, when the temperature range to which the current temperature of the liquid crystal display device 50 belongs changes to another temperature range. In other words, with the arrangement in which four LUTs are stored in the table memory 13, it becomes possible to further reduce the number of times that processing of obtaining the LUT from the external memory 5 is carried out. Accordingly, it becomes possible to further improve the processing speed of the liquid crystal drive circuit 1.

(Switch Processing in a Case where Three LUTs are Stored)

Figure 5:
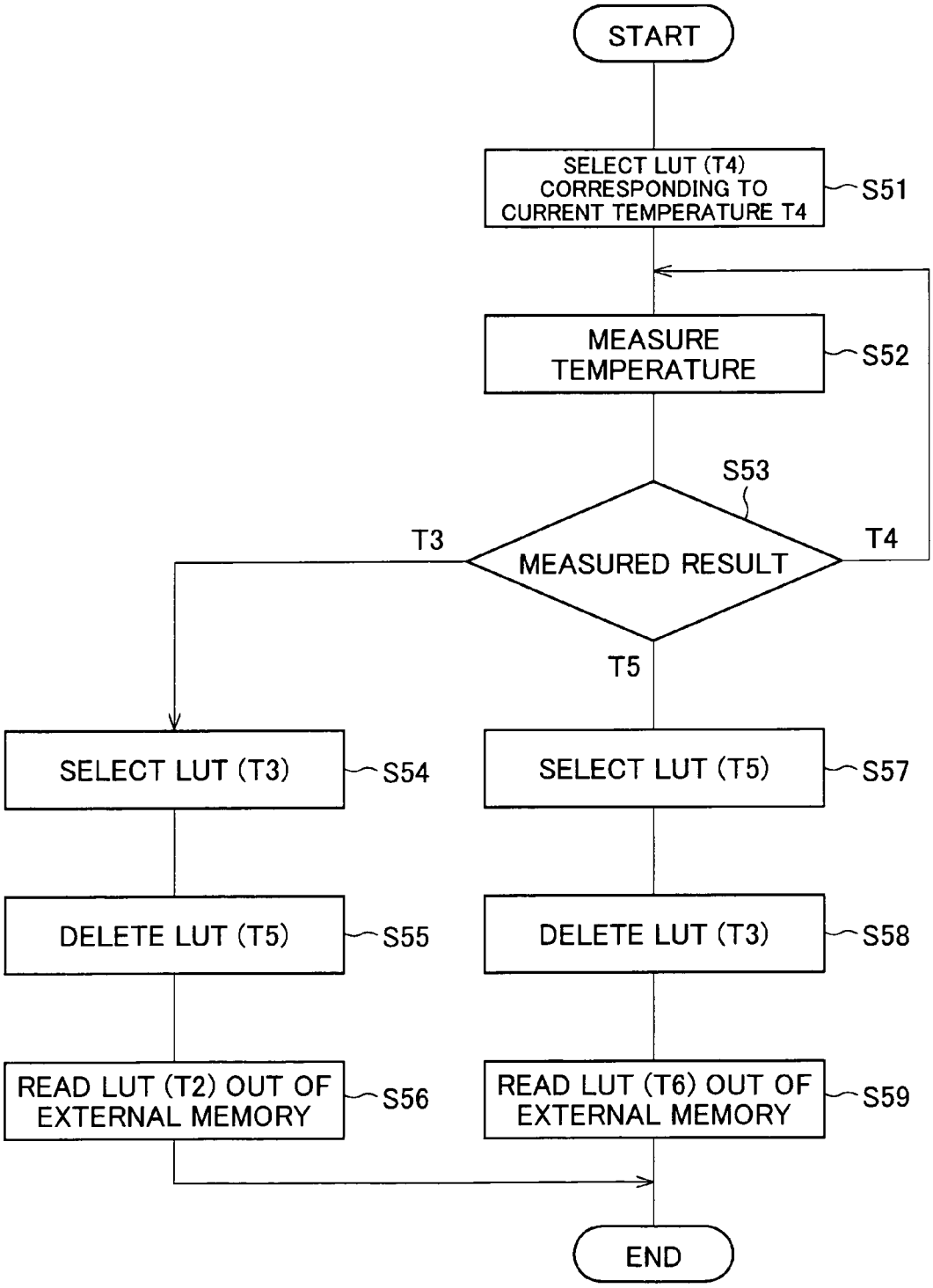
FIG. 5 is a flow chart illustrating a flow of switch processing in a case where the liquid crystal drive circuit changes a combination of three LUTs stored in the table memory, depending on changes in the temperature range to which a current temperature of the liquid crystal display device belongs.

The following explains a flow of the processing illustrated in FIG. 3 with reference to FIG. 5. FIG. 5 is a flow chart illustrating how the liquid crystal drive circuit 1 changes a combination of three LUTs stored in the table memory 13, depending on changes in temperature range to which the current temperature of the liquid crystal display device 50 belongs.

Here, the current temperature of the liquid crystal display device 50 belongs to the temperature range T4, for example. At this time, three tables, namely the LUTs (T3) through (T5), are stored in the table memory 13. As illustrated in FIG. 5, the overshoot calculation section 10 selects, among these LUTs, the LUT (T4) corresponding to the current temperature range T4, as the LUT used in the overshoot calculation (Step S51).

Then, the temperature sensor 4 measures the temperature of the liquid crystal panel 3 (Step S52). Next, the overshoot calculation section 10 judges which temperature range the current temperature of the liquid crystal display device 50 belongs to (Step S53).

If, in Step S53, the overshoot calculation section 10 judges that the temperature of the liquid crystal display device 50 belongs to the temperature range T4, the overshoot calculation section 10 continues to use the LUT (T4), which is being used. Accordingly, the LUTs (T3) through (T5) continue to be stored in the table memory 13.

On the other hand, if, in Step S53, the overshoot calculation section 10 judges that the current temperature of the liquid crystal display device 50 belongs to the temperature range T3, the overshoot calculation section 10 selects the LUT (T3) (Step S54). That is, the table that is being used in the overshoot calculation is switched over from the LUT (T4) to the LUT (T3).

Then, the table managing section 12 deletes the LUT (T5) from the table memory 13 (Step S55). This secures the memory capacity. Further, the table managing section 12 reads the table LUT (T2), which is located before the LUT (T3), out of the external memory 5, and stores the LUT (T2) in the table memory 13 (Step S56).

With such processing, the LUTs (T2) through (T4) are stored in the table memory 13.

Meanwhile, if, in Step S53, the overshoot calculation section 10 judges that the current temperature of the liquid crystal display device 50 belongs to the temperature range T5, the overshoot calculation section 10 selects the LUT (T5) (Step S57). That is, the table that is being used in the overshoot calculation is switched over from the LUT (T4) to the LUT (T5).

Then, the table managing section 12 deletes the LUT (3) from the table memory 13 (Step S58). This secures the memory capacity. Further, the table managing section 12 reads the table LUT (T5), which is located after the LUT (T4), out of the external memory 5, and stores the LUT (T5) in the table memory 13 (Step S59).

With such processing, the LUTs (T4) through (T6) are stored in the table memory 13.

(Switch Processing in a Case where Four LUTs are Stored)

Figure 6:
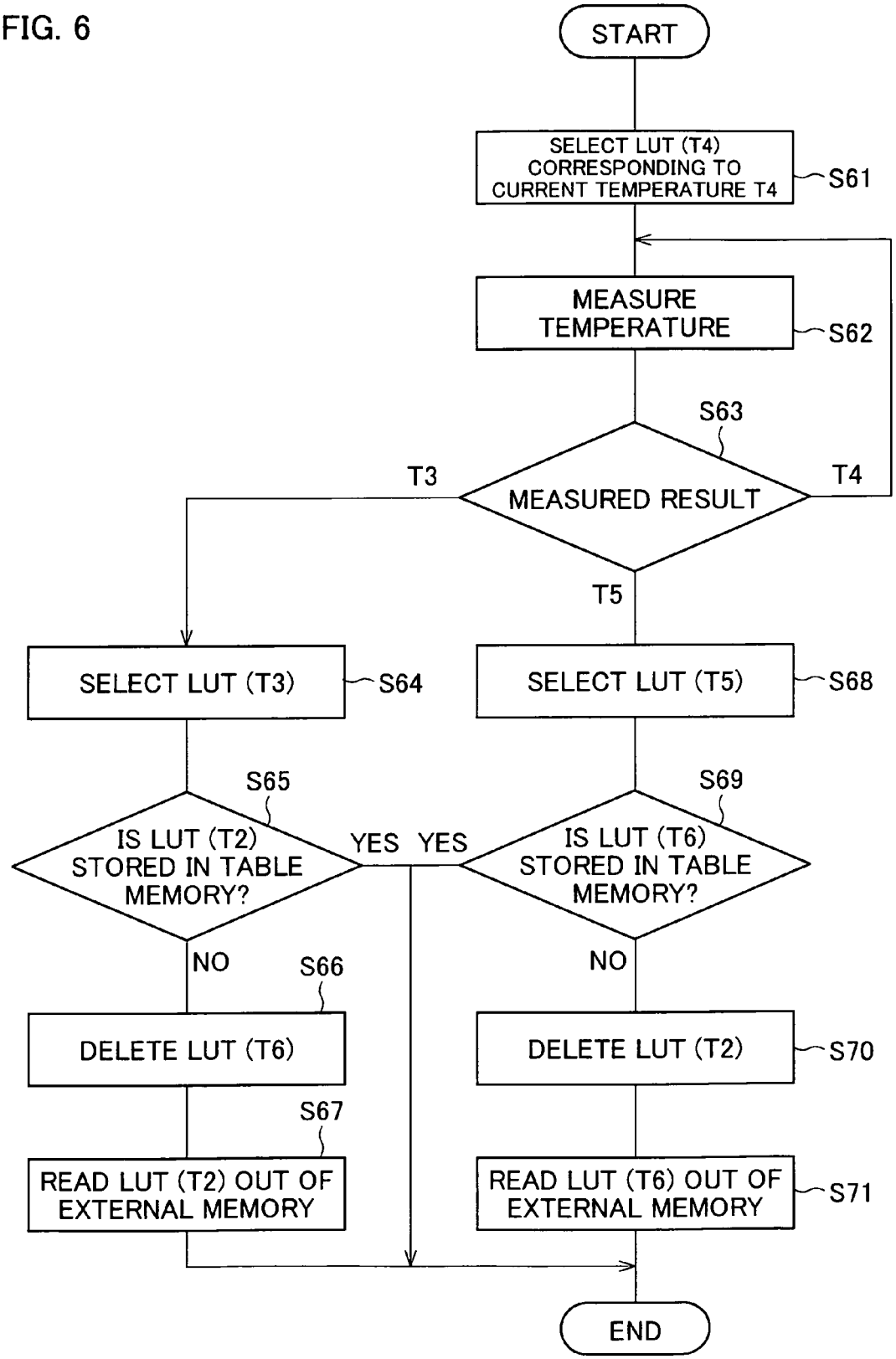
FIG. 6 is a flow chart illustrating a flow of the switch processing in a case where the liquid crystal drive circuit changes a combination of four LUTs stored in the table memory, depending on changes in the temperature range to which a current temperature of the liquid crystal display device belongs.

The following explains a flow of the processing illustrated in FIG. 4 with reference to FIG. 6. FIG. 6 is a flow chart illustrating how the liquid crystal drive circuit 1 changes a combination of four LUTs stored in the table memory 13, depending on changes in temperature range to which the current temperature of the liquid crystal display device 50 belongs.

Here, the current temperature of the liquid crystal display device 50 belongs to the temperature range T4, for example. At this time, four tables, namely the LUTs (T2) through (T5), are stored in the table memory 13. As illustrated in FIG. 6, the overshoot calculation section 10 selects, among these LUTs, the LUT (T4) corresponding to the temperature range T4 to which the current temperature of the liquid crystal display device 50 belongs, as the table used in the overshoot calculation (Step S61).

Then, the temperature sensor 4 measures the temperature of the liquid crystal display device 50 (Step S62). With Step S62, the overshoot calculation section 10 judges which temperature range the current temperature of the liquid crystal display device 50 belongs to (Step S63).

If, in Step S63, the overshoot calculation section 10 judges that the current temperature of the liquid crystal display device 50 belongs to the temperature range T4, the overshoot calculation section 10 continues to use the LUT (T4), which is being used. Accordingly, the LUTs (T2) through (T5) continue to be stored in the table memory 13.

On the other hand, if, in Step S63, the overshoot calculation section 10 judges that the current temperature of the liquid crystal display device 50 belongs to the temperature range T3, the overshoot calculation section 10 selects the LUT (T3) (Step S64). That is, the table that is being used in the overshoot calculation is switched over from the LUT (T4) to LUT (T3).

Next, the table managing section 12 judges whether or not the LUT (T2) is stored in the table memory 13 (Step S65). If the result in Step S65 is "True (Yes)", the table managing section 12 does not perform any processing. Accordingly, the combination of the tables stored in the table memory 13 is not changed.

On the other hand, if the result in Step S65 is "False (No)", the table managing section 12 judges that it is necessary for the table memory 13 to store the LUT (T2), which is located before the LUT (T3) that is being used. Therefore, first, the managing section 12 deletes the LUT (T5) from the table memory 13 (Step S66). This secures the memory capacity. The table managing section 12 reads the table LUT (T2) out of the external memory 5, and stores the LUT (T2) in the table memory 13 (Step S67).

With such processing, the LUTs (T2) through (T5) are stored in the table memory 13.

On the other hand, if, in Step S63, the overshoot calculation section 10 judges that the current temperature of the liquid crystal display device 50 belongs to the temperature range T5, the overshoot calculation section 10 selects the LUT (T5)

(Step S68). That is, the table that is being used in the overshoot calculation is switched over from the LUT (T4) to the LUT (T5).

Then, the table managing section 12 judges whether or not the LUT (T6), which is located after the LUT (T5) that is being used, is stored in the table memory 13 (Step S69). If the result in Step S65 is "True (Yes)", the table managing section 12 does not perform any processing. Accordingly, the combination of the LUTs stored in the table memory 13 is not changed.

On the other hand, if the result in Step S65 is "False (No)", the table managing section 12 judges that it is necessary for the table memory 13 to store the LUT (T6). Therefore, first, the table managing section 12 deletes the LUT (T2) from the table memory 13 (Step S70). This secures the memory capacity. Further, the table managing section 12 reads the LUT (T6) out of the external memory 5, and stores the LUT (T6) in the table memory 13 (Step S71).

With such processing, the LUTs (T3) through (T6) are stored in the table memory 13.

(Use of Difference LUT)

In the examples described above, the table memory 13 stores the tables that the overshoot calculation section 10 can use without modification. Alternatively, the table memory 13 may store difference tables for producing the tables that the overshoot calculation section 10 uses. Here, the difference table is difference data between a table corresponding to a certain temperature range, and a table corresponding to a temperature range which is adjacent to the certain temperature range. In a case where the overshoot calculation section 10 uses difference tables, the overshoot calculation section 10 produces a necessary table dynamically. Specifically, the overshoot calculation section 10 produces the table by applying a difference table stored in the table memory 13 to the table stored in the resister region 14, when switching over the table that is being used to another table.

(Change in Combination of Difference Tables)

Figure 7:
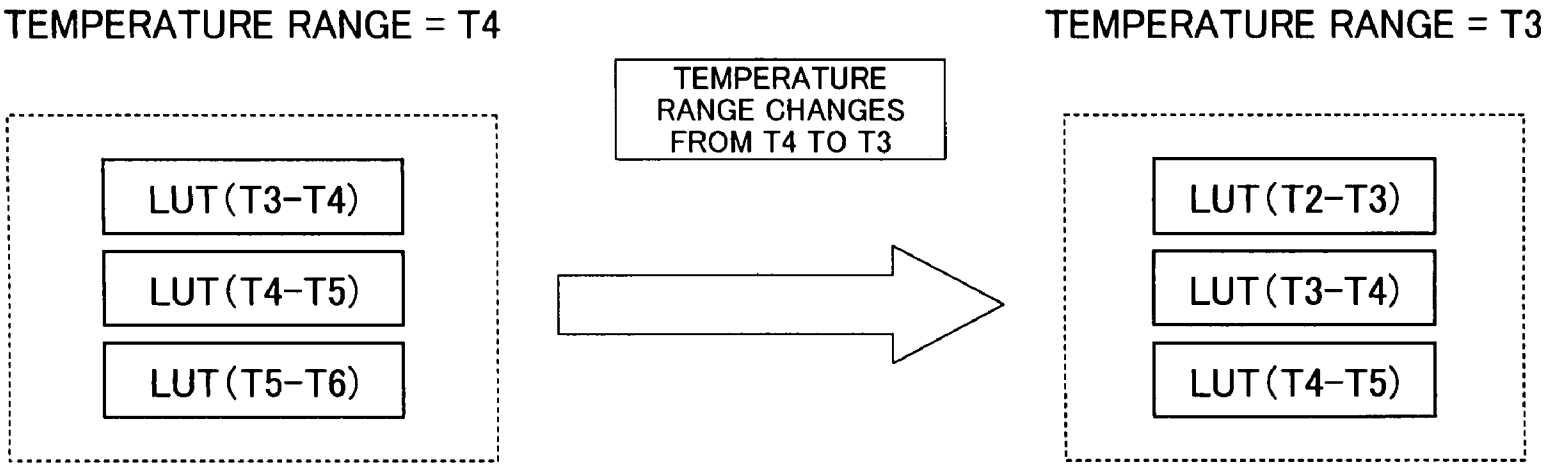
FIG. 7 illustrates how a combination of three difference LUTs stored in the table memory is changed along with a change in the temperature range to which a current temperature of the liquid crystal display device belongs.

FIG. 7 illustrates how a combination of three difference tables stored in the table memory 13 is changed along with a change in temperature range to which the current temperature of the liquid crystal display device 50 belongs.

Here, the current temperature of the liquid crystal display device 50 belongs to the temperature range T4, for example. At this time, a total of three difference tables are stored in the table memory 13, as illustrated in FIG. 7. That is, the following three difference tables are stored in the table memory 13.

A difference table LUT (T3-T2) which is based on a difference between the table LUT (T4) corresponding to T4 and the table LUT (T3) corresponding to the temperature range T3 that is adjacent to, and lower than T4.

A difference table LUT (T4-T5) which is based on a difference between the table LUT (T4) corresponding to T4 and the table LUT (T5) corresponding to the temperature range T5 that is adjacent to, and higher than T4.

A difference table (T5-T6) which is based on a difference between the table LUT (T5) corresponding to T5 and the table LUT (T6) corresponding to the temperature range T6 that is adjacent to, and higher than T5.

Here, the temperature range to which the current temperature of the liquid crystal display device 50 belongs changes from T4 to T3, for example. At this time, the overshoot calculation section 10 switches over from the LUT (T4), which is being used, to the LUT (T3). Specifically, the LUT (T3) is created by applying the difference table LUT (T3-T4) to the LUT (T4) stored in the register region 14.

At this point, the LUT (T3-T4) has been already stored in the table memory 13 in the liquid crystal drive circuit 1. Accordingly, the overshoot calculation section 10 reads the LUT (T3-T4) not out of the external memory 5 but out of the table memory 13, and applies the LUT (T3-T4) to the LUT (T4) stored in the register region 14.

Usually, a difference table is transferred from the external memory 5 to the liquid crystal drive circuit 1 at a speed considerably slower than a speed at which the difference table is reads out from the table memory 13. Accordingly, by reading out the difference table that has been already stored in the table memory 13, it becomes possible for the overshoot calculation section 10 to further reduce a period for switching over between LUTs. This can further speed up the over shoot calculation processing.

Further, not the tables which correspond to the temperature ranges respectively but the difference tables are stored in the table memory 13. Therefore, it is possible to reduce the amount of memory of the table memory 13, as compared with a case where the tables are stored in the table memory 13 without any modification. In other words, it becomes possible to (i) reduce the overshoot calculation processing period, and simultaneously, (ii) further reduce the amount of memory of the whole liquid crystal display device 50.

(Example of Storing Four Difference Tables)

In an example illustrated in FIG. 7, a total of three difference tables are stored in the table memory 13 in advance, that is, the difference LUT corresponding to the temperature range to which the current temperature of the liquid crystal display device 50 belongs, and the difference LUTs corresponding to the temperature ranges adjacent to the above temperature range. However, the number of the difference LUTs stored in the table memory 13 is not limited to three. The table memory 13 may store any number of difference LUTs as long as the number is at least four, and one less than the number of all of the difference LUTs stored in the external memory 5. The following explains an example of a case where a total of four difference LUTs, including the difference LUT corresponding to the temperature range to which the current temperature of the liquid crystal display device 50 belongs, are stored in the table memory 13 in advance.

Figure 8:
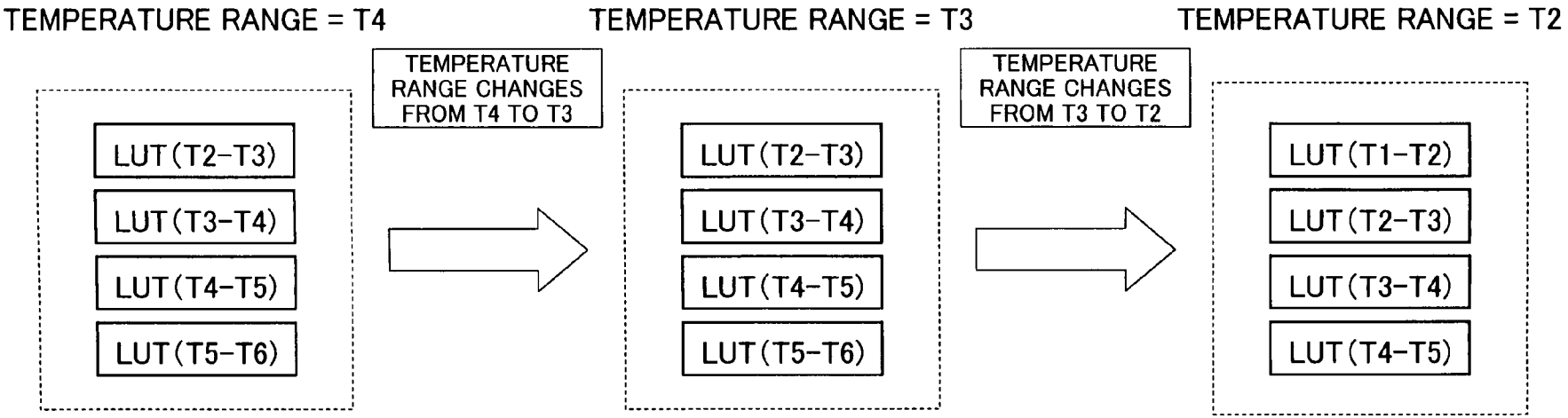
FIG. 8 illustrates how a combination of four difference LUTs stored in the table memory is changed along with changes in the temperature range to which a current temperature of the liquid crystal display device belongs.

FIG. 8 illustrates how a combination of four difference LUTs stored in the table memory 13 is changed along with changes in the current temperature range to which the temperature of the liquid crystal display device 50 belongs.

Here, the temperature of the liquid crystal display device 50 belongs to the temperature range T4, for example. At this time, the following four difference tables are stored in the table memory 13 in advance.

A difference LUT (T2-T3) corresponding to T2.

A difference LUT (T3-T4) corresponding to T3.

A difference LUT (T4-T5) corresponding to T4.

A difference LUT (T5-T6) corresponding to T5.

Here, the temperature range to which the current temperature of the liquid crystal display device 50 belongs changes from T4 to T3, for example. At this time, the overshoot calculation section 10 switches over from the LUT (T4), which is being used, to the LUT (T3). The difference LUT (T3-T4) for producing the LUT (T3) has been already stored in the table memory 13 in the liquid crystal drive circuit 1. Accordingly, the overshoot calculation section 10 reads the difference table (T3-T4) not out of the external memory 5 but out of the table memory 13, and creates the LUT (T3-T4) by applying the difference LUT (T3-T4) to the LUT (T4) stored in the resister region 14.

Two difference LUTs located adjacent to the difference LUT (T3-T2), that is, the difference LUTs (T2-T3) and (T4-T5), have been already stored in the table memory 13.

Accordingly, the table managing section 12 does not change the combination of the LUTs stored in the table memory 13.

Here, the temperature range to which the current temperature of the liquid crystal display device 50 belongs changes from T3 to T2. At this time, the overshoot calculation section 10 switches over from the LUT (T3), which is being used, to the LUT (T2). The difference LUT (T2-T3) has been already stored in the table memory 13 in the liquid crystal drive circuit 1. Accordingly, the overshoot calculation section 10 reads the LUT (T2-T3) not out of the external memory 5 but out of the table memory 13, and creates the LUT (T2) by applying the LUT (T2-T3) to the LUT (T3) stored in the register region 14.

At this time, the LUT that is being used by the overshoot section 10 has been changed from the LUT (T3) to the LUT (T2). Therefore, it is necessary for the table memory 13 to store the difference LUT (T2-T3) corresponding to the current temperature range T2, and the difference LUTs (T1-T2) and (T3-T2), which are located adjacent to the difference LUT (T2-T3).

The difference LUT (T3-T2) has been already stored in the table memory 13. However, the difference LUT (T2-T1) is not stored in the table memory 13. The temperature sensor 4 has given the table managing section 12 a notice that the temperature range to which the current temperature of the liquid crystal display device 50 belongs changed from T3 to T2. Therefore, the table managing section 12 obtains, from the external memory, the difference LUT (T1-T2) corresponding to the temperature range T1 that is adjacent to, and lower than the current temperature range T2, and stores the LUT (T1-T2) in the table memory 13. Meanwhile, the managing section 12 deletes the difference LUT (T5-T6) from the table memory 13.

With such processing, in a case where the current temperature of the liquid crystal display device 50 belongs to the temperature range T2, a total of four tables, namely the difference LUTs (T1-T2) through (T4-T5), are stored in the table memory 13.

(Use of LUTs Corresponding to Frequencies)

In the examples described above, the overshoot calculation section 10 selects an LUT corresponding to a temperature range to which the current temperature belongs, and uses the LUT in the overshoot calculation. However, in the liquid crystal display device 50, the overshoot calculation section 10 may select and use an LUT corresponding to a current physical property among a plurality of physical properties of the liquid crystal display device 50. Here, the plurality of physical properties are ones that are switched over continuously in the liquid crystal display device 50. Therefore, the physical property can be a temperature range to which the temperature of the liquid crystal display device 50 belongs, or an operating frequency of the liquid crystal display device 50, for example.

Accordingly, the overshoot calculation section 10 may select an LUT corresponding to an operating frequency (physical property) of the liquid crystal display device 50, for example. In this case, an LUT corresponding to the current operating frequency, and also LUTs corresponding to operating frequencies into which the current operating frequency may change next are stored in the table memory 13 in advance. On the other hand, all of LUTs, which are set in advance to correspond to operating frequencies of the liquid crystal display device 50 respectively, are stored in the external memory 5.

Figure 9:
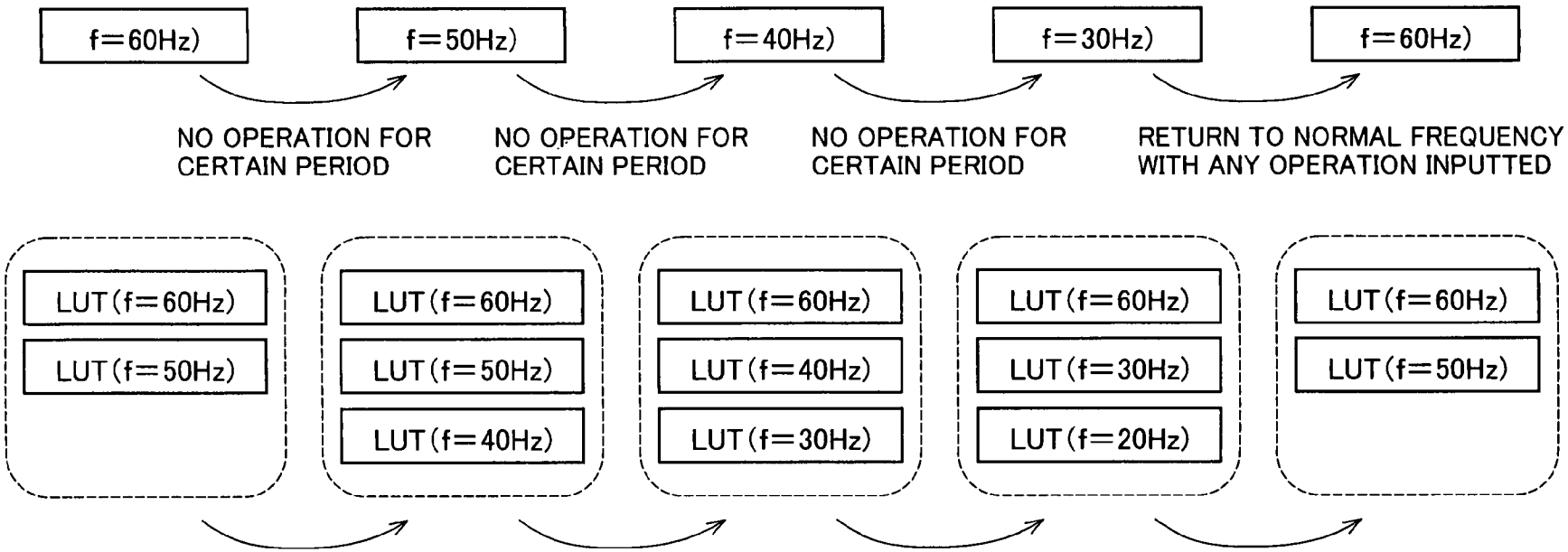
FIG. 9 illustrates how a combination of LUTs stored in the table memory is changed along with changes in operating frequency.

As an example, the following explains how a combination of the LUTs stored in the table memory 13 is changed depending on changes in operating frequency, with reference to FIG. 9. FIG. 9 illustrates how the combination of the LUTs stored in the table memory 13 is changed depending on changes in operating frequency.

The liquid crystal display device 50 operates at the operating frequency of 60 Hz, 50 Hz, 40 Hz, 30 Hz, or 20 Hz. Therefore, an LUT (f=60 Hz) corresponding to 60 Hz, an LUT (f=60 Hz) corresponding to 50 Hz, an LUT (f=40 Hz) corresponding to 40 Hz, an LUT (f=30 Hz) corresponding to 30 Hz, and an LUT (f=20 Hz) corresponding to 20 Hz are stored in the external memory 5 in advance.

In a case where the operating frequency is 60 Hz, the LUT (f=60 Hz) that is used at the frequency of 60 Hz, and the LUT (f=50 Hz) that is used at the frequency of 50 Hz, are stored in the table memory 13 in advance. If no operation is inputted into the liquid crystal display device 50 for a certain period, the operating frequency decreases by stages. For; example, the frequency of 60 Hz decreases by 10 Hz to 50 Hz. In other words, 60 Hz does not change into any hertz but 50 Hz. Accordingly, the LUTs (f=60 Hz) and (f=50 Hz) are stored in the table memory 13.

Here, no operation is inputted into the liquid crystal display device 50 for a certain period, and the operating frequency changes from 60 Hz into 50 Hz, for example. At this time, the overshoot calculation section 10 switches over from the LUT (f=60 Hz), which is being used, to the LUT (f=50 Hz). The LUT (f=50 Hz) has been already stored in the table memory 13, so that the overshoot calculation section 10 reads the LUT (f=50 Hz) not out of the external memory 5 but out of the table memory 13, and uses the LUT (f=50 Hz).

If the operating frequency is 50 Hz, and no operation is still inputted into the liquid crystal display device 50, the operating frequency changes into 40 Hz. On the other hand, the operating frequency returns to 60 Hz, if any operation is inputted into the liquid crystal display device 50. That is, the operating frequency may change from 50 Hz into 60 Hz or 40 Hz at this time. Accordingly, it is necessary for the table memory 13 to store the LUT (f=40 Hz) corresponding to the operating frequency of 40 Hz.

Therefore, when the operating frequency changes from 60 Hz into 50 Hz, the table managing section 12 obtains the LUT (f=40 Hz) corresponding to the operating frequency of 40 Hz from the external memory 5, and stores the LUT (f=40 Hz) in the table memory 13. Accordingly, as illustrated in FIG. 9, a total of three LUTs are stored in the table memory 13, that is, the LUT (f=50 Hz) corresponding to the current operating frequency of 50 Hz, the LUT (f=50 Hz) corresponding to the operating frequency of 60 Hz, and the LUT (f=40 Hz) corresponding to the operating frequency of 40 Hz.

If the operating frequency is 40 Hz, and no operation is still inputted into the liquid crystal display device 50, the operating frequency changes into 30 Hz. On the other hand, the operating frequency returns to 60 Hz if any operation is inputted into the liquid crystal display device 50. That is, the operating frequency may change from 40 Hz into 60 Hz or 30 Hz. Accordingly, it is necessary for the table memory 13 to store the LUT (f=30 Hz) corresponding to the operating frequency of 30 Hz.

Therefore, when the operating frequency changes from 50 Hz into 40 Hz, the table managing section 12 obtains the LUT (f=40 Hz) corresponding to the operating frequency of 40 Hz from the external memory 5, and stores the LUT (f=40 Hz) in the table memory 13. Meanwhile, the operating frequency does not change from 40 Hz into 50 Hz. Accordingly, the table managing section 12 deletes the LUT (f=50 Hz) corresponding to the operating frequency of 50 Hz from the table memory 13.

With such processing, a total of three LUTs are stored in the table memory 13, that is, the LUT (f=40 Hz) corresponding to the current operation frequency of 40 Hz, the LUT (f=60 Hz) corresponding to the operating frequency of 60 Hz, and the LUT (f=30 Hz) corresponding to the operating frequency of 30 Hz.

In the same way, when the operating frequency changes from 40 Hz into 30 Hz, a total of three LUTs are stored in the table memory 13, that is, the LUT (f=30 Hz) corresponding to the current operating frequency of 30 Hz, the LUT (f=60 Hz) corresponding to the operating frequency of 60 Hz, and the LUT (f=20 Hz) corresponding to the operating frequency of 20 Hz.

If the operating frequency is 30 Hz, and any operation is inputted into the liquid crystal display device 50, the operating frequency changes into 60 Hz. At this time, the LUT (f=60 Hz) corresponding to the operating frequency of 60 Hz has been already stored in the table memory 13. Therefore, the overshoot calculation section 10 reads the LUT (f=60 Hz) out of the table memory 13, and uses the LUT (f=60 Hz) in the overshoot calculation.

The operating frequency does not change from 60 Hz into any hertz but 50 Hz. Therefore, when the operating frequency changes from 30 Hz into 60 Hz, the table managing section 12 deletes both the LUTs (f=30 Hz) and (f=20 Hz) from the table memory 13. Meanwhile, the table managing section 12 obtains the LUT (f=50 Hz) corresponding to the operating frequency of 50 Hz, and stores the LUT (f=50 Hz) in the table memory 13.

Accordingly, the LUT (f=60 Hz) corresponding to the current operating frequency of 60 Hz, and the LUT (f=50 Hz) corresponding to the operating frequency of 50 Hz are stored in the table memory 13.

As described above, the present invention can be suitably applied to a display device which controls electric power consumption by controlling the operating frequency depending on presence or absence of operation instructions. In the same manner as a device that switches over the LUT that is being used to another LUT, depending on the temperature, it is possible to improve the processing speed, and also to reduce the amount of memory of the whole device.

The present invention is not limited to the description of the embodiments above, but may be altered within the scope of the claims. An embodiment based on a proper combination of technical section disclosed in different embodiments is encompassed in the technical scope of the present invention.

For example, a drive circuit according to the present invention is not limited to the liquid crystal drive circuit 1 for the liquid crystal display device 50, but may be realized as various drive circuits for various display devices. For this reason, a display device of the present invention is not limited to the liquid crystal display device 50, but may be realized as a display device not using liquid crystal but using other display technologies, such as a plasma display device.

Further, it is possible to arrange the table memory 13 and the register region 14 integral together as one portion. In this case, the LUT that is actually used by the overshoot calculation section 10 may be stored not in the register region but in the table memory 13.

As described above, a drive circuit according to the present invention includes: an internal memory for storing at least three tables which respectively correspond to a plurality of the physical properties which are continuously switched over in the display device, the number of said at least three tables is less, by at least one, than the number of all of tables which are stored in an external memory and are provided for the different physical properties, respectively; and table managing section to (i) obtain a table located before a first end table from the external memory so as to store the table in the internal memory, and deleting a second end table from the internal memory, in a case where the conversion section newly uses the first end table, and (ii) obtaining a table located after the second end table from the external memory so as to store the table in the internal memory, and deleting the first end table from the internal memory, in a case where the conversion section newly uses the second end table, the first and second end tables being stored in the internal memory, a table located after the first end table being stored in the internal memory but a table located before the first end table not being stored in the internal memory, and a table located before the first end table being stored in the internal memory but a table located after the second end table not being stored in the internal memory. Thereby, the drive circuit of the present invention can (i) operate at the same processing speed as a drive circuit in which all of the tables are stored in the internal memory, and simultaneously (ii) to reduce the amount of internal memory.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The present invention is suitable for widespread use as a drive circuit for driving various display devices.

The invention claimed is:

1. A drive circuit comprising:

a conversion section to convert input image data into output image data by using a table, corresponding to a current physical property, among at least three tables which are prepared respectively for different numerical ranges of a physical property of a display device, and each of which defines a relationship between input image data and output image data;

an internal memory configured to store the at least three tables, including a lower table corresponding to a lower numerical range of the physical property, a middle table corresponding to a middle numerical range of the physical property and an upper table corresponding to a upper numerical range of the physical property, the number of said at least three tables is less, by at least one, than the number of all tables which are stored in an external memory and are provided for the different numerical ranges of the physical property, respectively; and a table managing section configured to, (i) obtain a table that corresponds to a numerical range of the physical property lower than the numerical range of the physical property corresponding to the lower table from the external memory so as to store the table in the internal memory, and delete the upper table from internal memory, if the conversion section newly uses the lower table, and (ii) obtain a table that corresponds to a numerical range of the physical property greater than the numerical range of the physical property corresponding to the upper table from the external memory so as to store the table in the internal memory, and delete the lower table from the internal memory, if the conversion section newly uses the upper table, wherein the table managing section;

allows a table corresponding to a numerical range of the physical property that is adjacent to the numerical range of the physical property of the lower table to be stored in the internal memory, does not allow a table corresponding to a numerical range of the physical property that is not adjacent to either the numerical range of the physical property of the lower table or the numerical range of the physical property of the upper table not to be stored in the internal memory, and allows a table corresponding to a numerical range of the physical property that is adjacent to the numerical range of the physical property of the upper table to be stored in the internal memory.

2. The drive circuit according to claim 1, wherein:

each of the numerical ranges of the physical property are a temperature range to which a temperature of the display device belongs.

3. The drive circuit according to claim 1, wherein:

among all of the tables stored in the external memory, three tables, which respectively correspond to three of the ranges of the physical property which are continuously switched over in the display device, are stored in the internal memory.

4. The drive circuit according to claim 1, wherein:

among all of the tables stored in the external memory, four tables, which respectively correspond to four of the ranges of the physical property which are continuously switched over in the display device, are stored in the internal memory.

5. A drive circuit, comprising:

a conversion section to convert input image data into output image data by using tables, which respectively correspond to different numerical ranges of a physical property of a display device, and each of which defines a relationship between input data and output data;

a table creating section configured to create a table that the conversion section uses, the table creating section creating the table by applying a difference table to a table corresponding to the current physical property, the difference table being based on a difference between the table corresponding to the current physical property and a table corresponding to another physical property;

an internal memory configured to store at least three difference tables, including a lower table corresponding to a lower numerical range of the physical property, a middle table corresponding to a middle numerical range of the physical property and an upper table corresponding to a upper range of the physical property, the number of said at least three difference tables being less, by at least one, than the number of all of difference tables which are stored in an external memory and are provided for the different numerical ranges of the physical property, respectively; and a difference table managing section configured to, (i) store, in the internal memory, a difference table, obtained from the external memory, the difference table corresponding to a numerical range of the physical property that is lower than the numerical range of the physical property corresponding to the lower difference table, and delete the upper difference table from the internal memory, if the table creating section newly uses the lower difference table, and (ii) store, in the internal memory, a difference table, obtained from the external memory, the difference table corresponding to a numerical range of the physical property that is greater than the numerical range of the physical property corresponding to the upper difference table, and delete the lower difference table from the internal memory, if the table creating section newly uses the upper difference table, wherein the difference table managing section:

allows a difference table corresponding to a numerical range of the physical property that is adjacent to the numerical range of the physical property of the lower difference table and less than the numerical range of the physical property of the upper difference table to be stored in the internal memory, does not allow a difference table corresponding to a numerical range of the physical property that is not adjacent to either the numerical range of the physical property of the lower table or the numerical range of the physical property of the upper table to be stored in the internal memory, and allows a difference table corresponding to a numerical range of the physical property that is adjacent to the numerical range of the physical property of the upper table to be stored in the internal memory.

6. The drive circuit according to claim 5, wherein:

each of the numerical ranges of the physical property is a temperature range to which a temperature of the display device belongs.

7. The drive circuit according to claim 5, wherein:

among all of the difference tables stored in the external memory, three difference tables, which respectively correspond to three of the ranges of the physical property which are continuously switched over in the display device, are stored in the internal memory.

8. The drive circuit according to claim 5, wherein:

among all of the difference tables stored in the external memory, four difference tables, which respectively correspond to four of the ranges of the physical property which are switched over in the display device, are stored in the internal memory.

9. A display device comprising the drive circuit recited in claim 1.

* * * * *